United States Patent [19]

Rieffel

[11] Patent Number: 4,914,837

[45] Date of Patent: Apr. 10, 1990

[54] SANDAL WITH CONTAINED GRANULAR MATERIAL TO PROVIDE A PAD FOR A PERSON'S FOOT

[76] Inventor: Donald W. Rieffel, 3402 E. Seneca, Tucson, Ariz. 85716

[21] Appl. No.: 293,010

[22] Filed: Jan. 3, 1989

[51] Int. Cl.[4] ..... A43B 1/00; A43B 11/00

[52] U.S. Cl. ..... 36/88; 36/115; 36/71

[58] Field of Search ..... 36/88, 93, 71, 119, 36/58.5, 58.6, 91, 92, 1 R

[56] References Cited

U.S. PATENT DOCUMENTS

| | | | |
|---|---|---|---|
| 1,954,122 | 4/1934 | Fiori | 36/71 |
| 2,400,023 | 5/1946 | Potter | 36/8.5 |
| 2,449,936 | 9/1948 | Glasgow | 36/7.1 R |
| 2,774,152 | 12/1956 | Alber | 36/71 |
| 3,006,084 | 10/1961 | Le Compte | 36/58.5 |
| 3,177,596 | 4/1965 | Siger | 36/7.1 R |
| 3,235,981 | 2/1966 | Kloss | 36/58.5 |
| 3,237,319 | 3/1966 | Hanson | 36/71 |
| 3,416,174 | 12/1968 | Noutske | 36/9 R |
| 3,419,974 | 1/1969 | Lange | 36/89 |
| 3,464,125 | 9/1969 | Conway | 36/2.5 |
| 3,472,508 | 10/1969 | Baker et al. | 36/93 |
| 3,693,270 | 9/1972 | Murray | 36/71 |
| 4,227,320 | 10/1980 | Borgeas | 36/88 |
| 4,236,725 | 12/1980 | Bataille | 36/93 |
| 4,550,511 | 11/1985 | Gamm | 36/50 |
| 4,638,518 | 1/1987 | Eiteljorg, II | 36/119 |
| 4,726,126 | 2/1988 | Bernhard | 36/88 |
| 4,821,431 | 4/1989 | Rieffer | 36/88 |

FOREIGN PATENT DOCUMENTS

| | | | |
|---|---|---|---|
| 496056 | 11/1938 | United Kingdom | 36/71 |

*Primary Examiner*—Steven N. Meyers

*Attorney, Agent, or Firm*—J. Michael McClanahan

[57] ABSTRACT

An improvement in footwear consisting of sandal footwear having an interior plenum adapted to contain sand or other granular material, the sand providing a natural environment walking surface for the bottom of a person's foot. The footwear has a lower shell and attached bottom sole to form a cuplike shell with upraised heel part, and an upper cover joining the lower shell and covering the front top portion of the footwear to form with the lower shell the plenum leading to the ankle inlet/outlet mouth. Situated interiorly to the enclosed plenum upper cover is a toe pad providing a defined spacial clearance between itself and the persons's toes, the pad adapted to be engaged by the foot when the foot lifts the footwear for purposes of retaining the sandal upon the person's foot while being moved. Additionally, an annular ankle pad is situated interiorly to the inlet/outlet mouth of the footwear, the annular ankle pad adapted to continually engage the wearer's upper ankle to contain the granular material, and also to serve to intercept the person's instep as the person pivots their foot upward as they walk, thus helping to bring the footwear along with the foot. The described invention permits the free movement of the contained granular material allowing it to transform and continually conform to the shape of the person's foot as the person utilizes the sandal in walking, and to thereby provide a healthful and comfortable article of footwear.

10 Claims, 1 Drawing Sheet

SANDAL WITH CONTAINED GRANULAR MATERIAL TO PROVIDE A PAD FOR A PERSON'S FOOT

BACKGROUND OF THE INVENTION

1. Field of the Invention

The field of the invention is novel sandals which contain loose sand or other granular material forming a pad continually conforming to the shape of a person's foot as the sandal is being walked upon.

2. Description of the Related Art

The enclosed described invention is an improvement upon the Inventor's prior invention as described in U.S. patent application Ser. No. 192,165 and filed May 10, 1988 entitled SANDAL WITH CONTAINED GRANULAR MATERIAL TO PROVIDE A PAD FOR A PERSON'S FOOT.

The Inventor's prior invention relates to sandal footwear which provides an envelope or container to confine sand or other granular material adapted to be in contact with the wearer's bare foot, permitting the foot to make its own pattern in the sand or granular material as the wearer brings his foot down with its different and various points of pressure The sandal also provides the bare foot with maximum freedom from restraint and with minimum closure of the footwear about the foot.

The prior invention provided in its article of footwear a lower shell and sole portion which contacted the ground surface, the lower shell and sole portion providing a cuplike plenum housing a mid-sole, the mid-sole providing various shapes such as a forward going or backward going wedge, or having a constant thickness from toe to heel. The sand or granular material resided atop the mid-sole to provide a layer or pad upon which the wearer's bare foot resided.

The sandal provided three straps encircling the foot, firstly at the area of the toe, the instep, and then the person's heel. The toe and instep straps were so designed to be spaced above the person's foot when the person was standing in the sandal but, as the person raised his foot in walking or otherwise moving his foot, the foot would rise up to engage the straps in order to bring the sandal along with the person's foot as he moved. To achieve this, $\frac{1}{8}$ to $\frac{1}{2}$ inch clearance was allowed between the top of the person's toes and the bottom of the toe strap, as well as a greater clearance between the person's instep and the instep strap. Both straps were attached to the upper portions of the lower shell containment apparatus with the toe strap and the instep strap fixedly attached to opposite sides of the lower shell proximate the same area of the feet.

The heel strap, however, was adapted to continually engage the wearer's heel in a rather snug, although not tight, manner. The heel strap was also attached to the upper portions of the lower shell in the area of the forward or toe portion of the lower shell, however, provisions were made in order that the heel strap should be permitted to pivot upward to allow the person's heel to move substantially above the pad of sand and mid-sole of the sandal as the person walks.

This combined function of the pivoting heel strap, intermittently engaging instep strap and rearward inclining mid-sole is to keep the sand distributed at a relatively level surface for the bare foot to impinge upon.

At the front top portion of the sandal footwear was a plastic or fabric upper cover which attached to the upper portions of the lower shell in its front section and then joined with the up-raised heel portion of the lower shell to form the inlet/outlet or mouth of the sandal which provided entrance into the sandal and also encompassed the person's ankle. In addition, brush like bristles spanned the distance between the sandal mouth and the person's ankle in order to provide a top closure or seal to prevent escape of sand or other contained granular material.

The inventor has made substantial improvements upon his prior invention in doing away with the interior straps and substituting other novel means to contain the foot, but yet allow the freedom from restraint desired. The novel improvements added by the Inventor obviate problems associated with interior straps, such as the person getting his toes caught in the straps when first the wearer enters the sandal with his foot, as well as the problems associated with having the straps not being the correct length and/or not providing the correct clearance above various person's various sized feet, especially with respect to a person's arches.

Accordingly, it is apparent that there would be great value in improving sandals having contained granular material to provide a pad for a person's foot to obviate problems of interiorly located straps.

SUMMARY OF THE INVENTION

This invention relates to a novel sand or other granular material containing sandal footwear which permits a wearer to walk on a pad surface formed by the loose natural granular material with his bare foot while at the same time providing the bare foot with maximum freedom from restraint. The footwear also permits the wearer to convey with him the granular material as he walks. More specifically, the subject invention is an improvement upon the inventor's prior invention which provides all of the above, yet adds improvements which allow the sandals to be placed on the feet with less problems and which compensates for the various shaped feet of different people.

The description of the prior art previously discussed sets out the sandal footwear to which the improvements of this invention have been added. In accordance with the invention, the interiorly contained toe and instep straps are removed and a specially shaped toe pad situated in the volume above the person's toe area is provided and in addition, the need of the heel strap is obviated by other means situated in the upper heel portion of the sandal footwear to provide the containment mechanism for preventing the foot from coming out of the sandal and to carry the sandal along as the wearer moves his feet.

In place of the toe strap and the instep strap formerly attached to the upper portions of the lower shell, the Inventor has affixed a specially shaped toe pad against the upper cover portion of the sandal footwear. The toe pad is specifically designed to provide clearance between a person's toe and to also provide an improvement which does not interfere with the person inserting his foot into the sandal and avoids the person's toes catching the instep strap or the toe strap upon insertion.

The toe pad comprises specially selected open cell foam material which is resilient, yet not easily compressible (but will with a substantial amount of pressure, finger-wise), and that the material readily returns to its original shape when the pressure is relieved. In addition, provisions for placement and removal of the toe pad is provided by the addition of Velcro material to its upper surface and to the lower interior surface of the upper cover of the sandal footwear. In order that the stiff pad material not provide a source of abrasion to the person's foot when it contacts the toe pad, a soft fabric material is added to the underside of the toe pad.

The bristle like top closure material located at the inlet/outlet mouth of the sandal footwear in the prior invention has been replaced in the present invention with an annular ankle pad utilizing the same type foam material as used in the toe pad and also similarly utilizing Velcro material to hold the annular ankle pad in place against the inside walls of the sandal footwear. Additionally, the interior peripheral surface of the annular ankle pad is also covered with soft fabric material. Similarly to the top closure previously described, the annular ankle pad surrounds the wearer's ankle and always engages the wearer's skin, yet allowing the ankle to rotate upward and forward as one goes through the walking motion.

The annular ankle pad, in addition, provides the added feature of an instep restraint which receives the person's instep as the person rotates his foot upward from the ball of the foot. As such, the instep strap on the prior art invention has been obviated and the new top closure means now performs the function formerly accomplished by the instep strap.

Lastly, in the rear side portions of the sandal footwear are medial and lateral heel centering guides or pads constructed to provide loose engagement of the sides of the upper heel and/or ankle of the wearer in order to confirm alignment of the invention to the wearer's foot.

In an alternate embodiment, an air bladder is inserted interiorly to the toe pad and the ankle annular pad in order that all the pad thicknesses may be varied in accordance with different shaped feet, or to the desires and wishes of the wearer.

It is an object of the subject invention to provide improvements to a novel sandal containing granular material providing a pad for the wearer's foot to obviate the problems associated with interior straps.

It is another object of the subject invention to provide a comfortable article of footwear giving the feeling of walking on sand, and being non-confining to a person's foot.

It is still another object of the subject invention to provide means where the interior foot restraining means may be adjusted to conform to various person's feet.

Other objects of the invention will in part be obvious and will in part appear hereinafter. The invention accordingly comprises apparatus comprising the construction, combination of elements, and arrangement of parts which are exemplified in the following detailed disclosure and the scope of the application of which will be indicated in the claims.

BRIEF DESCRIPTION OF THE DRAWINGS

For further understanding of the nature and objects of the present invention, reference should be had to the following detailed description taken in conjunction with the accompanying drawings wherein.

In various views, like index numbers refer to like elements.

DETAILED DESCRIPTION OF THE PREFERRED EMBODIMENT

Figure 1:
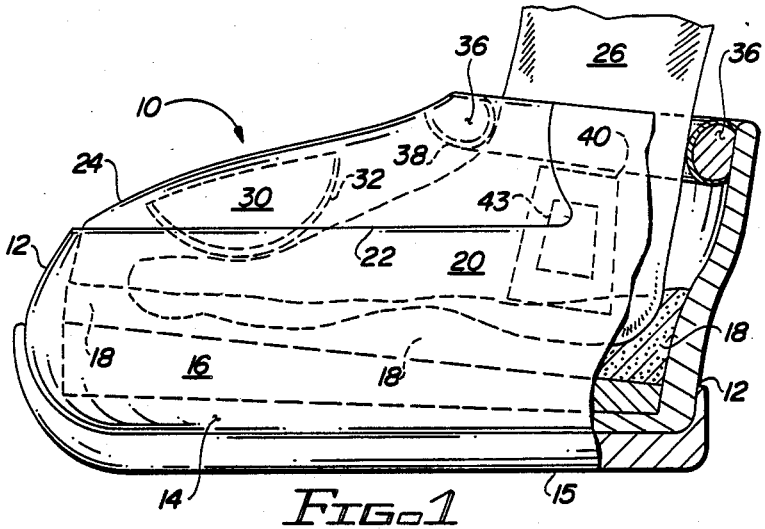
FIG. 1 is a side view with a partial cutaway of the preferred embodiment of the subject invention showing the interior portions of the sandal.

Referring now to FIG. 1, a side view of the subject footwear with a partial cutaway view is shown detailing the improvements which have been added to the inventor's prior sandal which permits the wearer to walk on a natural granular surface. Sandal 10 shown in FIG. 1 consists of the following major elements, namely, a combined lower shell and sole consisting of an upper situated lower shell 12 and the bottom sole 14, bottom sole 14 adapted to provide the support to the granular material containment mechanism. Additionally added to the subject footwear with an appropriate adhesive has been an outside sole 15, a pliable rubber or plastic bottom layer adapted to provide the lowermost base of the sandal which touches and engages the ground or sidewalk. In the preferred embodiment, the combined lower shell 12 and sole 14 may be constructed of one piece of flexible plastic, such as polyvinylchloride (PVC), and manufactured by injection molding or other appropriate process. Held within the lower part of cup-like combined lower shell 12 and sole 14 is mid-sole 16 which is a removable element and insertable into lower shell 14. It receives on its top surface the granular material to form a pad which in turn receives the person's foot. This mid-sole is preferably constructed of material which is resilient, i.e., compressible but bounces back, such as a dense polyethylene foam. If desired, an adhesive may hold mid-sole 16 in place. Mid-sole 16 shown in FIG. 1 is backward sloping, however the invention described also accomodates mid-soles which are forward sloping or of constant thickness front to rear. Immediately above mid-sole 16 is situated the loose granular material 18 such as sand or the like on which the person's foot 20 is adapted to rest. As is obvious from the inherent characteristic of loose granular material, the granular material will conform to the shape or print of a person's foot such that proper support of the foot on all portions of its bottom is provided, even for those feet having a high arch.

Attached to the top rim portion 22 of the forward portion of upper shell 12 is the upper cover 24 which rises above lower shell 12 to surround, but spaced away from the toes and instep of foot 20. The upper cover is attached by sewing, an adhesive, or to make readily removable by use of Velcro material, the lower shell 12 and upper cover 24 forming together an open mouthed container to encompass the person's foot.

The improvements made to the inventor's prior invention as described herein are concerned with the doing away of the multiple straps which were situated interiorly to the lower shell 12 and upper cover 24. These prior art straps, of which there were three, consisted firstly of a toe strap bridging the top rim portion 22 of lower shell 12 in the vicinity of the person's toes; a second instep strap also was connected to the lower shell 12 near its top rim 22 in the vicinity of the person's instep; and lastly, a third heel strap which surrounded the person's ankle, was also connected to the top rim portion 22 in the forward toe area of the lower shell 12. The toe strap and the instep strap were adapted to be loose, and not touching the person's toes or instep when the person's foot was in the sandal and the sandal was flat on the floor, such as when standing. The heel strap, however, engaged the wearer's heel at all times, although not tightly.

Because of the obvious shortcomings of using straps, firstly in the manufacture of the sandal, secondly in the lack of give in the straps once they were engaging the person's foot, and thirdly, the opportunities presented the wearer's toes to catch on the straps when inserting their feet, the Inventor has devised new and different apparatus to provide the means for securing the sandal to the person's foot when the person is moving and lifting the sandal. The same philosophy as in the prior invention is employed, i.e., that the means replacing the straps shall not touch the toes nor the instep of the person's foot when the person is standing in the sandal, but yet, with the person's foot moving up a small amount of distance, such as ⅛ to ½ inch for the toe and up to an inch or more for the instep, such means will engage the person's toes and instep to keep the sandal and its enclosed granular material on the person's foot.

Figure 3:
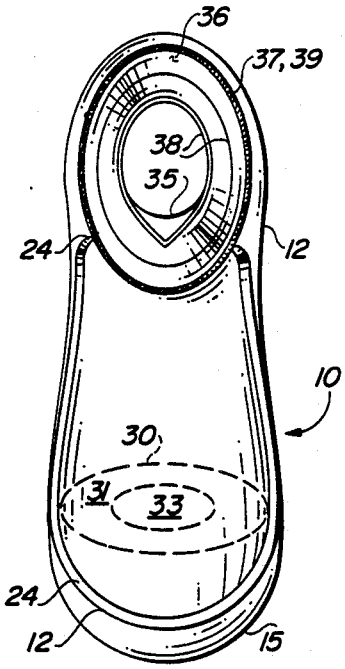
FIG. 3 is a top view of the subject invention showing the toe pad portion of the invention in dotted fashion and the top of the annular ankle pad portion of the invention in full view.

Such means are shown in FIG. 1 in dotted form and in cross-sectional view. These means consist in part of toe pad 30 shown situated immediately above the person's toe. Toe pad 30 is attached to the underside of upper cover 24 by means of an adhesive or mechanical fastener such as a Velcro material type fastener. If Velcro is utilized, which it suggested, it is recommended that the Velcro material situated on the top surface of toe pad 30 should cover the entire top surface and should be that type of Velcro material which is smooth to the feel, i.e., the loop type. Then, against the lower surface of upper cover 24 is attached a smaller pad of the supplemental or opposite type of Velcro material which is rough to the touch, i.e., the hook type. FIG. 3, later discussed, illustrates the proposed surface area that each type of the Velcro material is suggested to cover.

Next, replacing the top closure bristle material surrounding the top outlet mouth portion of the sandal 10 that the Inventor utilized in his prior patent is the next part of the subject invention, with an annular ankle pad 36 adapted to surround the person's ankle 26, all for the twofold purpose of providing a seal to prevent the granular material from escaping from the containment envelope and to provide a holding or securing mechanism for keeping the foot contained in the sandal during periods of movement. The front portion of the annular ankle pad 36 engages the instep of the person's foot as the person pivots the heel portion of his foot off the ball of the foot when walking. This permits the heel to raise up as one normally walks and to bring along the sandal with the foot. For ease of viewing, the annular ankle pad 36 has been shown in cross-section at the point where it is engaging opposite sides of the rear upper portion of the wearer's ankle.

As an additional support to the mechanism holding the foot within the sandal is the last part of the invention, namely a pair of rear located oppositely situated pads 40 and 41 (not shown) on the lateral and medial sides of the ankle. These pads are so situated so as not to engage the lateral and medial sides of the ankle when the foot is standing in the sandal, but to reside a short distance away, nominally ⅛ to ¼ inch. These medial and lateral pads provide side to side alignment so that any tendency on the sandal to roll is avoided so that in walking the bottom ground engaging sole 15 will always be hitting the ground flat so long as the foot is properly oriented with respect to the ground. These medial and lateral support pads are shaped like a truncated triangle as shown in FIG. 1 and, like the toe pad 30 and the annular ankle pad 36, are covered on the inside portion with a soft fabric material, such as velour. On the surface of medial pad 40 shown in FIG. 1 away from ankle 26 is similarly attached the Velcro material as has been accomplished in toe pad 30 and annular ankle pad 36, which Velcro material attaches to Velcro material 43 which in turn is connected to the inside surface of lower shell 12 and a portion of upper cover 24. A similar scheme with respect to types of particular Velcro materials used for the surface of medial pad 40 is adapted as was utilized in the other pads above described.

In all the pads shown, for that portion of the pad which engages the person's foot, or which may possibly engage the person's foot as the pad may deform, a surface covering or layer of preferably soft velour type fabric is suggested. This is shown in FIG. 1 by the soft material fabric 32 attached to the underside surface of toe pad 30, soft fabric material 38 attached to the inside foot facing portion of annular ankle pad 36, and soft fabric material attached to the foot facing surface of medial pad 40.

Figure 2:
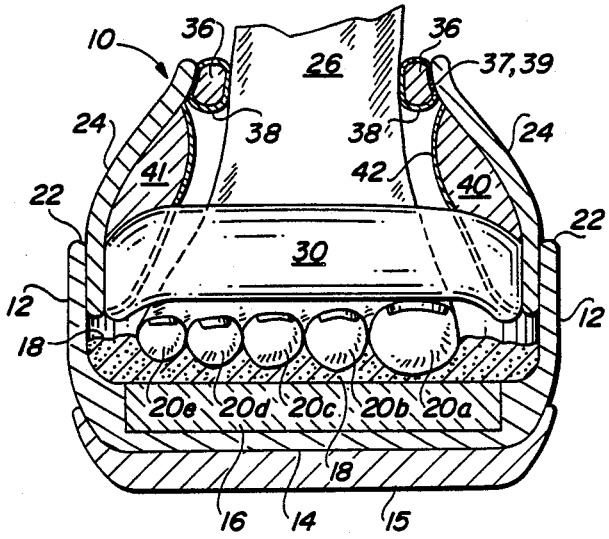
FIG. 2 is a front view of the preferred embodiment of the subject invention with the front portion of the sandal removed to reveal the interior elements as seen from the front.

Referring now to FIG. 2, a front view of the subject invention with a portion of the upper cover 24 removed, and with lower shell 12, mid-sole 16, sole 14, and bottom sole 15 is shown in cross-section. Proceeding from the bottom upward, bottom sole 15 which contacts the ground is firstly illustrated followed by sole 14 which, together with lower shell 12, is preferably one piece of molded plastic. Bottom sole 15 is then attached to sole 14 with an adhesive and may be a replaceable type sole. Immediately above sole 14 is mid-sole 16 which, as detailed in the inventor's prior patent, is removable and when inserted in the inventive sandal, provides the base to receive the granular material and then the person's foot. Mid-sole 16 may in different embodiments, be wedge shaped, either in the direction of the front to the rear or vice versa, or may be of constant thickness. Additionally shown is granular material 18 together with the various toes **20*a*–20*e*** of the person's right foot.

Thereafter, immediately above the toes, and not touching the toes or the foot, is one of the subject improvements, namely toe pad 30. As shown in FIG. 2, pad 30 is wider than the person's foot and stretches from side to side under the upper cover 24 and curves downward at the ends to encompass, but not touch, the outside toes. The upper portion of toe pad 30 obviously resides against the inside top surface of upper cover 24. Next, and at the top of the sandal, shown in cross-sectional view, are the sides of annular ankle pad 36, attached to the upper portion of upper cover 24 (and also attached to the upper mouth part of lower shell 12 in the rear top half part of the sandal), and adapted to engage the person's ankle 26 with soft fabric material 38, such as velour. Velcro material 37 and 39 is shown securing the annular pad 36 to upper cover 24. Additionally shown in FIG. 2 is the medial ankle pad 40 and the lateral ankle pad 41 which attach to the sides of lower shell 12 proximate opposite sides of the ankle and serve to guide the subject sandal so that it is always aligned with the foot. As indicated above, the medial and lateral ankle pads are covered on the foot facing sides with a soft fabric material 42, such as velour, and then covered with Velcro material on the sides that face the inside of the sandal.

Referring now to FIG. 3, a top view of the inventive improved sandal is shown wherein firstly, the front portion of the sandal, namely bottom sole 15, is detailed, followed by lower shell 12 and upper cover 24. Shown in dotted relief beneath upper cover 24 is the peripheral edge of toe pad 30 which also corresponds to the edge of the Velcro material 31. Then shown centrally to toe pad 30 is the complimentary Velcro material 33 which is attached to the lower inside surface of upper cover 24. This latter Velcro material 33, which as indicated earlier is rough to the touch (hook portion), is substantially smaller in size than the smooth Velcro material 31 (loop portion) attached to toe pad 30 in order that when toe pad 30 is removed, either for cleaning or replacement, and replaced, the person can be reasonably sure that it will be fully covered by the soft Velcro material 31, even if toe pad 30 is slightly misplaced. Velcro material 31 was chosen to be the soft sided Velcro type material in the event that if during use, toe pad 30 may begin to roll over at its edges, the possibility that rough or abrasive type Velcro material might be exposed to the person's foot is avoided.

Continuing in FIG. 3, at the top of the sandal 10 outlet mouth is shown annular ankle pad 36 completely surrounding the ankle inlet/outlet. Annular ankle pad 36 is, as indicated earlier, held in place by the paired two Velcro materials 37 and 39 which attach respectively to the annular ankle pad and to the inside surface of the upper portions of lower shell 12 and upper cover 24. On the immediate interior curved surface of annular ankle pad 36 is the soft fabric material 38, material 38 reaching back upon annular ankle pad 36 to contact the Velcro material 37 attached to the outside peripheral surface. Shown in FIG. 3 is optional front pad 35 attached to annular ankle pad 36, front pad 35 made of a very soft foam material, easily compressed, and which may be either open or closed cell. It bridges any gap that may exist between annular ankle pad 36 and the person's upper ankle area in order to minimize any possibility that the contained granular material may escape. This optional front pad would be attached to the soft velour or other fabric material lining the inside of annular ankle pad 36. Material used will be soft to the touch so there would be no necessity for adding an additional soft outside cover to it.

Figure 4:
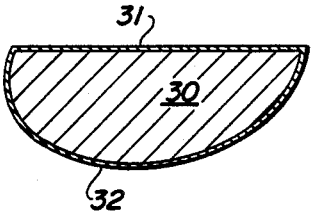
FIG. 4 is a side cross-sectional view of the toe pad portion of the invention.

Referring now to FIG. 4, a cross-sectional view of toe pad 30 is shown. Situated centrally to toe pad 30 is the material which provides a somewhat stiff but resilent, although compressible substance, for engagement by a person's toes when the inventive sandal is lifted by the foot. The Inventor has had good results using a stiff, reticulated, open cell polyurethane foam commercially sold as a "filter foam". This material provides resistance to being compressed yet, after being compressed and released, returns to its original shape. It is obvious, however, that other types of materials may be used for toe pad 30 including wad cotton, small closed cell rubber pads, and other types of plastic and rubber foams. While desirable, it is obvious that pad 30 need not necessarily have the characteristics which have been listed above as desirable, such as being rather stiff to compression between one's fingers. Clearly at some time, the foot's upward movement (relative to the sandal) will be halted by upper cover 24, so regardless of the type of material used, the sandal footwear will raise up with the foot. Additionally shown in FIG. 4 is the smooth Velcro material 31 which is placed upon the top surface of toe pad 30 adapted to be mated to the rough Velcro material 33 (shown in FIG. 3) which is attached to the lower surface of upper cover 24. On the bottom surface of toe pad 30 is located the soft fabric material 32, such as a soft velour or other type of material. It is this material which will be primarily contacted by the person's toes. As explained above, it is suggested that the soft fabric material 32 cover as much of the pad as possible since there may be times when the corners of the pad may turn down and for the sake of comfort of the person wearing the sandals, it is desirable that a person's foot not contact either the Velcro material or the foam material. Both the Velcro material on the top surface of pad 30 and the soft fabric material on the bottom surface of toe pad 30 are attached to the foam material by an adhesive, or if impossible to use an adhesive, the foam material may be inserted into a "pillow cover" type enclosure made from the Velcro and fabric materials.

Figure 5:
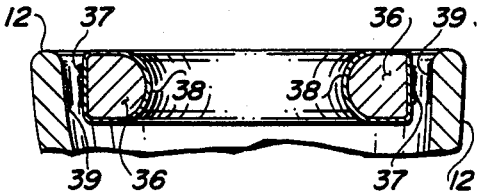
FIG. 5 is a cross-sectional view of the annular ankle pad portion of the invention.

FIG. 5 is a cross-sectional view of annular ankle pad 36 taken at the ankle inlet/outlet of the subject footwear 10. Here are also shown the upper portions of lower shell 12 in cross-section together with the means of securing annular ankle pad 36 in place. To that end, Velcro covering 37 is attached to the outside periphery of annular ankle pad 36 which mates to the Velcro material 39 attached to the inside peripheral surface of lower shell 12. Like the discussion above pertaining to which type of Velcro material will be used, on the annular ankle pad 36 it is again suggested that the type of Velcro which presents a soft feeling (loop type) to the touch be utilized to guard against the possibility that the foam might come in contact with the user's foot and provide a source of irritation to the foot. Accordingly, the mating type of Velcro material, nominally that which is abrasive to the touch, the hook type material, is attached to the lower shell 12. As in the toe pad 30, an appropriate adhesive is utilized to attach the Velcro materials 37 and 39 to their respective elements. Upon the inside peripheral surface of annular ankle pad 36 is attached a similar soft fabric material 38, again such as velour. As suggested in connection with toe pad 30, the soft fabric material 38 is recommended to be placed around annular ankle pad 36 to the point where it meets the soft sided Velcro material 37 in order that the person's foot not have to contact the interior foam material. Here also, like toe pad 30, if needed, a "pillow cover" type arrangement may be made to encompass the foam.

Figure 6:
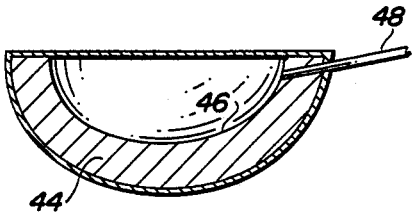
FIG. 6 is a cross-sectional side view of an alternate embodiment of the toe pad.

FIG. 6 shows an alternate embodiment of toe pad 30, here re-numbered to toe pad 44, wherein in order to adjust the size of the pad to regulate clearance above the person's foot and for different sized feet, an air bladder 46 is placed into a cavity formed in the side of toe pad 44. Access to the inflatable bladder is obtained by means of connecting tube 48 exiting the rear portion of toe pad 44 for the purposes of inflating or deflating bladder 46. The tube is then tied off or sealed by means of an inline valve after the bladder has been expanded to the desired size. The bladder, which may be made of pliable and flexible material such as rubber or plastic, occupies a cavity formed in the side of toe pad 44. It is suggested that bladder 46 be attached with an adhesive to the inside surface of the cavity.

Figure 7:
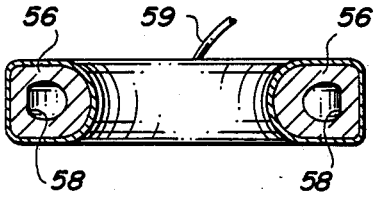
FIG. 7 is a cross-sectional view of the alternate embodiment of the annular ankle pad.

A similar device as shown in FIG. 6 is suggested for the annular ankle pad 56 shown in FIG. 7 wherein the interiorly located air bladder 58 is illustrated and functions similarly to the bladder shown in toe pad 44. Access to the interior of the bladder for purposes of inflation and deflation is provided by means of connecting tubing 59.

Although the bladder 58 shown in FIG. 7 is shown entirely encircling annular bladder 56, it may be desirable to locate bladder 58 in only one portion of annular ankle pad 56, for example, in the front facing portion. In such case, bladder 58 then may be expanded to cause the annular ankle pad to occupy that areas shown by the optional front pad 35 in FIG. 3. Then, the optional front pad 35 may be deleted. As an alternate, air bladder 58 may be constructed such that the bladder were made of thicker wall material for that portion of the annular pad which would be in the rear portion of annular ankle pad 56 with a lesser wall thickness bladder in the forward portion of annular ankle pad 56. Then, with inflation, a larger inflated volume would exist in the front part of the annular ankle pad.

While a preferred embodiment of the invention has been shown and described, together with alternate embodiments, it will be appreciated that there is no intent to limit the invention by such disclosure. Accordingly, the disclosure is intended to cover all modifications and alternate embodiments falling within the spirit and the scope of the invention as defined in the appended claims.

I claim:

1. An improvement in footwear providing an natural environment walking surface for the bottom of a person's foot as the person lifts and lowers their feet, the footwear of the type having: a lower shell defining an elongated cup-like structure having a front end, upraised heel portion, flat bottom sole with perpendicularly up extending sides, said sides partially enclosing the person's toes, heel, and portion of the ankle, and an enclosed mid-sole; an upper cover attached to the lower shell, the upper cover enclosing the person's toes and instep, the upper cover together with the lower shell forming an open mouthed container encompassing the person's foot; and granular material within the container interposed the lower shell mid-sole and the bottom of the person's foot, the improvement comprising:

means situated within the formed open mouthed container to intermittently engage the person's foot in the footwear, said means including:

(a) a toe pad of resilient material having a thickness operably attached to the upper cover and situated proximate the person's toes, said toe pad engaged by the person's toes within the footwear when the foot is lifted to bring the footwear along with the foot, said toe pad spaced away from the person's toes when the person stands in the footwear;

(b) an annularly shaped ankle pad of resilient material having a thickness operably attached to the upper cover and to the lower shell heel portion at the formed container open mouth, said annular ankle pad adapted to be engaged by the person's instep when the foot is lifted to bring said footwear along with the foot, said annular ankle pad loosely engaged by the person's upper ankle when the person is standing in the footwear and allowing the ankle to rotate upward and forward when the person walks.

2. The improvement in footwear as defined in claim 1 wherein said toe pad includes a contained air bladder, said air bladder adapted to be inflated to vary the thickness of said toe pad.

3. The improvement in footwear as defined in claim 2 wherein said annular ankle pad includes a contained air bladder, said air bladder adapted to be inflated to vary the thickness of said annular ankle pad.

4. The improvement in footwear as defined in claim 3 further including medial and lateral ankle pads operably attached to the lower shell and to the upper cover, said medial and lateral pads oppositely situated adjacent to the person's ankle, said medial and lateral ankle pads aligning said footwear to the person's foot as the foot is raised and lowered.

5. The improvement in footwear as defined in claim 4 wherein said toe pad operably attached to the upper cover is attached by Velcro material and is removable and replaceable.

6. The improvement in footwear as defined in claim 5 wherein said annular ankle pad operably attached to the upper cover and to the lower shell heel portion is attached by Velcro material and is removable and replaceable.

7. The improvement in footwear as defined in claim 6 wherein said medial an lateral ankle pads operably attached to the lower shell and to the upper cover are attached by Velcro material, and are removable and replaceable.

8. The improvement in footwear as defined in claim 7 wherein said toe pad comprises an open cell, reticulated plastic foam partially covered by a soft fabric material.

9. The improvement in footwear as defined in claim 8 wherein said annular ankle pad comprises an open cell, reticulated plastic foam partially covered with a soft fabric material.

10. The improvement in footwear as defined in claim 9 wherein said medial and lateral ankle pads comprise an open cell, reticulated plastic foam partially covered in a soft fabric material.

* * * * *